US009013262B2

(12) United States Patent
Morimoto et al.

(10) Patent No.: US 9,013,262 B2
(45) Date of Patent: Apr. 21, 2015

(54) COIL COMPONENT

(71) Applicant: Sumida Corporation, Tokyo (JP)

(72) Inventors: Yasunori Morimoto, Tokyo (JP); Masakazu Fukuoka, Miyagi (JP)

(73) Assignee: Sumida Corporation, Tokyo (JP)

( * ) Notice: Subject to any disclaimer, the term of this patent is extended or adjusted under 35 U.S.C. 154(b) by 145 days.

(21) Appl. No.: 13/692,300

(22) Filed: Dec. 3, 2012

(65) Prior Publication Data

US 2013/0154788 A1 Jun. 20, 2013

(30) Foreign Application Priority Data

Dec. 16, 2011 (JP) ..... 2011-276089

(51) Int. Cl.

| | |
|---|---|
| ***H01F 27/28*** | (2006.01) |
| ***H01F 27/06*** | (2006.01) |
| ***H01F 27/02*** | (2006.01) |
| ***H01F 5/00*** | (2006.01) |
| ***H01Q 7/08*** | (2006.01) |
| ***H01Q 1/27*** | (2006.01) |

(52) U.S. Cl.

CPC .. *H01F 5/00* (2013.01); *H01Q 7/08* (2013.01); *H01Q 1/273* (2013.01)

(58) Field of Classification Search

USPC ..... 336/65, 83, 200, 225, 231, 232, 190

See application file for complete search history.

(56) References Cited

U.S. PATENT DOCUMENTS 7,142,082 B2 * 11/2006 Kakehashi et al. ..... 336/182
2007/0046413 A1 * 3/2007 Yamashita et al. ..... 336/96

FOREIGN PATENT DOCUMENTS

EP 1727163 A1 * 11/2006
JP A-2006-66468 3/2006

* cited by examiner

*Primary Examiner* — Tsz Chan
(74) *Attorney, Agent, or Firm* — Oliff PLC

(57) ABSTRACT

A coil component includes: a bar-like core; and a winding part formed of a conducting wire that is wound in a plurality of layers around the outer periphery of the core according to a solenoidal winding method. Winding collapse preventing shifts D1 to D4 each corresponding to a plurality of turns between an end part of a lower winding layer and an end part of an upper winding layer are respectively set to both end parts in the winding width direction of winding layers of the winding part. In transitioning from the lower winding layer to the upper winding layer, the conducting wire is turned back from the end part of the lower winding layer, and is obliquely wound in a small number of turns across each winding collapse preventing shift corresponding to the plurality of turns, and dense winding of the upper winding layer is started.

6 Claims, 2 Drawing Sheets

COIL COMPONENT

RELATED APPLICATIONS

This application claims the priority of Japanese Patent Application No. 2011-276089 filed on Dec. 16, 2011, which is incorporated herein by reference.

BACKGROUND OF THE INVENTION

1. Field of the Invention

The present invention relates to a coil component including: a bar-like core not including a flange part; and a winding part (coil) formed of a conducting wire that is wound in a plurality of layers around the longitudinal outer periphery of the core.

2. Description of the Related Art

For example, in some cases, an antenna coil component (a coil component for a tag) is buried in the body of an animal to be used for ID registration for individual identification. In order to enable such a coil component to be housed in a cylindrical minute capsule, downsizing thereof is required, and, particularly the size thereof in the radial direction or the width direction is required to be, for example, as small as 5 mm or less.

In view of the above, a structure not including a flange part at its end parts is applied to a core around which a conducting wire is to be wound. This is advantageous in downsizing, and also is advantageous in accuracy of the shape of the core and occurrence suppression of warpage. In the case of using such a core not including a flange part, however, when a conducting wire is wound in a plurality of layers around the longitudinal outer periphery of the core according to a solenoidal winding method, winding collapse is likely to unfavorably occur at an end part of a winding part.

According to the solenoidal winding method, a conducting wire is wound from one end to another end to form a first layer, and the conducting wire is then turned back in the opposite direction from another end to one end to continuously form a second layer on the first layer. Then, when the turned-back second layer is wound on an end part of the first layer at the turned-back portion of the end part in the winding width direction, winding collapse is likely to occur. The winding collapse causes a trouble in coil characteristics. Moreover, if winding of the conducting wire is continued without solving the winding collapse, partial thickening occurs due to the winding, and the resultant disordered winding appearance hinders downsizing. For the coil component for a tag described above, which requires particular downsizing, insertion thereof into a minute capsule is not possible unfavorably.

In order to prevent such winding collapse as described above, it is conceived to fix the conducting wire in the winding part using a fusion wire. The fusion wire is formed by applying a bonding agent such as bond to a conducting wire, and serves to prevent winding collapse by joining turns of the wound conducting wire to each other. Unfortunately, the bonding agent is melt by heat, and the winding shape is deformed, resulting in unstable characteristics. Further, the bonding agent is thermally expanded, and a stress is applied to the core, resulting in an increase in stress resistance characteristics. Accordingly, measures to prevent winding collapse without using such a fusion wire are preferable.

Further, although not intended for measures to prevent winding collapse, at the time of the transition from a lower layer to an upper layer at an end part of the winding part, winding of the upper layer is started with a shift corresponding to one turn, whereby a wedge-like space is formed between an end surface of a flange part of the core and the winding wire. Such a technique is disclosed in Japanese Laid-Open Patent Publication No. 2006-66468A.

The winding structure disclosed in Japanese Laid-Open Patent Publication No. 2006-66468A can be expected to produce a slight effect of preventing winding collapse with reference to the drawings, but a shift corresponding to one turn is unrealistic in actual winding of a thin conducting wire. in particular, such a shift is almost impossible when a conducting wire is manually wound. Further, even if such a shift corresponding to one turn is possible, the winding at an end of the lower layer loosens, and the upper-layer conducting wire enters gaps between turns of the lower-layer conducting wire in many cases, instead of being wound on top of the lower-layer conducting wire. Accordingly, this is not an effective technique.

The flange part is formed in the core disclosed in Japanese Laid-Open Patent Publication No. 2006-66468A, and winding collapse of the winding part is substantially prevented by the flange part. Hence, the formation of the flange part is essential. Accordingly, the size of the coil component is large, so that the requirements for the antenna coil component (the coil component for a tag) as described above cannot be satisfied.

The present invention, which has been made in view of the above-mentioned circumstances, has an object to provide a coil component that can achieve downsizing thereof without providing a core with a flange part and enables solenoidal winding so as not to cause winding collapse without using a fusion wire.

SUMMARY OF THE INVENTION

In order to solve the above-mentioned problems, a coil component according to the present invention has the following features.

That is, a coil component according to the present invention includes: a bar-like core not including a flange part; and a winding part formed of a conducting wire that is wound in a plurality of layers around a longitudinal outer periphery of the core according to a solenoidal winding method while being turned back sequentially from a lower layer to an upper layer. The coil component further includes a winding collapse preventing shift corresponding to a plurality of turns between an end part of a lower winding layer and an end part of an upper winding layer, the winding collapse preventing shift being set to each end part in a winding width direction of each winding layer of the winding part. In a case of transition from the lower winding layer to the upper winding layer, the conducting wire is turned back from the end part of the lower winding layer, and is obliquely wound in a small number of turns across the winding collapse preventing shift corresponding to the plurality of turns, and dense winding of the upper winding layer is started.

In the coil component according to the present invention, the conducting wire may be dividedly wound in the winding part, and the conducting wire may be wound in each divided winding part in a state where the winding collapse preventing shift corresponding to the plurality of turns between the end part of the lower winding layer and the end part of the upper winding layer is set to each end part in the winding width direction of each winding layer of each divided winding part.

At that time, it is preferable that the conducting wire be wound in the winding part so as to be divided into the divided winding parts even in a lowermost winding layer.

In a case of transition from a given divided winding part to a next divided winding part during the divided winding, the conducting wire may be obliquely wound across a total shift of the winding collapse preventing shifts of a plurality of layers at an end part of the given divided winding part, and winding of a lowermost winding layer of the next divided winding part may be then started.

Although depending on characteristics such as a conducting wire diameter, the "plurality of turns" in the "winding collapse preventing shift corresponding to the plurality of turns" is preferably four to ten turns, which can achieve excellent winding collapse prevention.

The turning back of the conducting wire from the end part of the lower winding layer and the oblique winding thereof across the winding collapse preventing shift can prevent a disordered winding wire by loosening prevention, in addition to winding collapse prevention.

Further, the coil component according to the present invention is an antenna coil component that is buried in a body of an animal to be used for ID registration for individual identification.

DETAILED DESCRIPTION OF THE PREFERRED EMBODIMENTS

Hereinafter, embodiments of a coil component according to the present invention are described in detail with reference to the attached drawings.

<First Embodiment>

Figure 1:
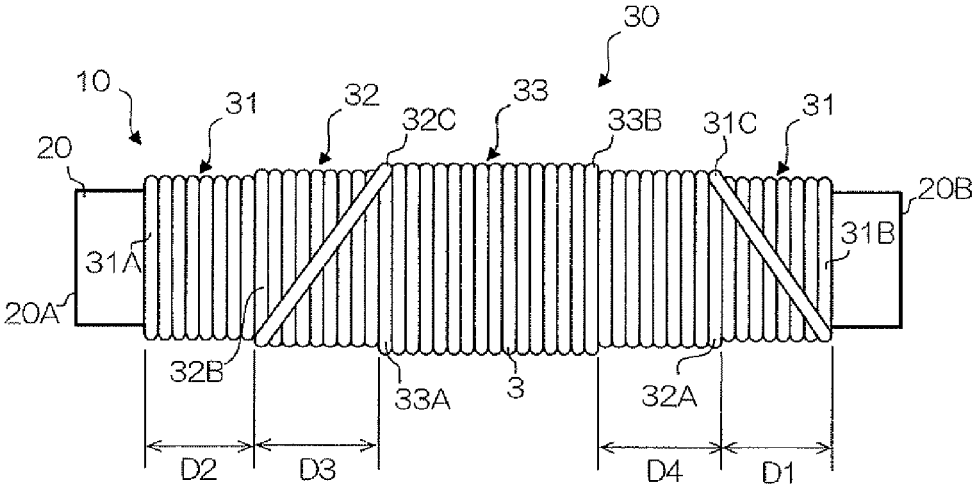
FIG. 1 is a schematic front view illustrating a coil component according to a first embodiment of the present invention.
Figure 2:
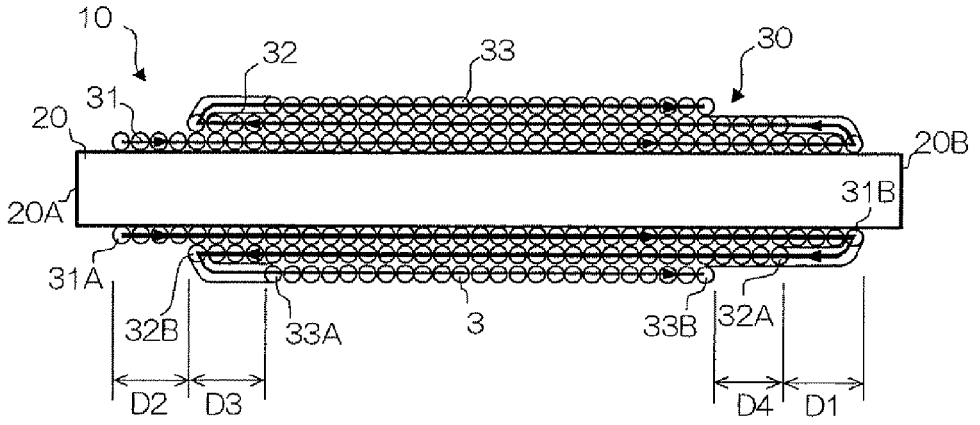
FIG. 2 is a schematic cross-sectional view illustrating a winding structure of a winding part in FIG. 1.

As illustrated in FIGS. 1 and 2, a coil component 10 according to a first embodiment of the present invention includes: a core 20 that does not include a flange part and is made of a bar-like magnetic body; and a winding part 30 formed of a conducting wire 3 that is simply wound in a plurality of layers around the longitudinal outer periphery of the core 20 according to a solenoidal winding method. In FIGS. 1 and 2, the winding part 30 is formed of three winding layers of a first winding layer 31, a second winding layer 32, and a third winding layer 33 in the stated order from the lower layer to the upper layer.

The winding structure according to the solenoidal winding method is described. First, dense winding of the conducting wire 3 from a left end part 31 A of the first winding layer 31 is started with a slight space being kept from a left end 20A of the core 20.

When the winding of the first winding layer 31 reaches a predetermined position at a right end part 31B of the wound first winding layer 31 with a slight space being kept from a right end 20B of the core 20, the conducting wire 3 is turned back in this portion, and winding from a right end part 32A of the second winding layer 32 is started on top of the first winding layer 31.

When the winding of the second winding layer 32 is started, a winding collapse preventing shift D1 is set, the winding collapse preventing shift D1 corresponding to a plurality of turns (in FIG. 1, corresponding to eight turns) from the right end part 31B of the first winding layer 31. Then, the winding from the right end part 32A of the second winding layer 32 is started.

At the time of the transition from the right end part 31B of the first winding layer 31 to the right end part 32A of the second winding layer 32, the conducting wire 3 is turned back from the right end part 31B of the first winding layer 31, and is obliquely wound in a small number of turns (in FIG. 1, in a ½ turn) across the winding collapse preventing shift D1, whereby oblique winding 31C is performed to provide a loosening preventing function. Then, dense winding of the second winding layer 32 is started. Specifically, the oblique winding 31C for loosening prevention is performed so as to fasten, from the outside, a portion of the winding wire 3 in two turns or more at the end part corresponding to the winding collapse preventing shift D1, whereby the occurrence of a disordered winding wire is prevented by the loosening prevention, in addition to the winding collapse prevention.

Next, the conducting wire 3 is densely wound in a predetermined number of turns on top of the first winding layer 31 from the right end part 32A to a left end part 32B of the second winding layer 32, and the conducting wire 3 reaches a position to which a predetermined winding collapse preventing shift D2 from the left end part 31A of the first winding layer 31 located below the second winding layer 32 is set. After the winding to the left end part 32B, the conducting wire 3 is turned back in the opposite direction, and dense winding from a left end part 33A of the third winding layer 33 is started on top of the second winding layer 32. At the time of this turning back, a winding collapse preventing shift D3 is set to the left end part 32B of the second winding layer 32 similarly to the above, and the conducting wire 3 is wound by oblique winding 32C in a small number of turns (in FIG. 1, in a ½ turn) across the winding collapse preventing shift D3. Then, the dense winding from the left end part 33A of the third winding layer 33 is started. Also in this case, the oblique winding 32C provides a loosening preventing function, and the oblique winding 32C for loosening prevention is performed so as to fasten, from the outside, a portion of the winding wire 3 in two turns or more at the end part corresponding to the winding collapse preventing shift D3, whereby the occurrence of a disordered winding wire is prevented by the loosening prevention, in addition to the winding collapse prevention.

Subsequently, the conducting wire 3 is wound in a predetermined number of turns from the left end part 33A to a right end part 33B of the third winding layer 33. Specifically, the conducting wire 3 is wound to a position of the right end part 33B of the third winding layer 33 as the uppermost layer, that is, to a position to which a predetermined winding collapse preventing shift D4 from the right end part 32A of the second winding layer 32 located below the third winding layer 33 is set. A leading end of the conducting wire 3 on the winding end side at the right end part 33B of the third winding layer 33 is taken out together with a leading end of the conducting wire 3 on the winding start side in the first winding layer 31, and both the leading ends thereof are connected to a circuit part (not illustrated).

<Second Embodiment>

Figure 3:
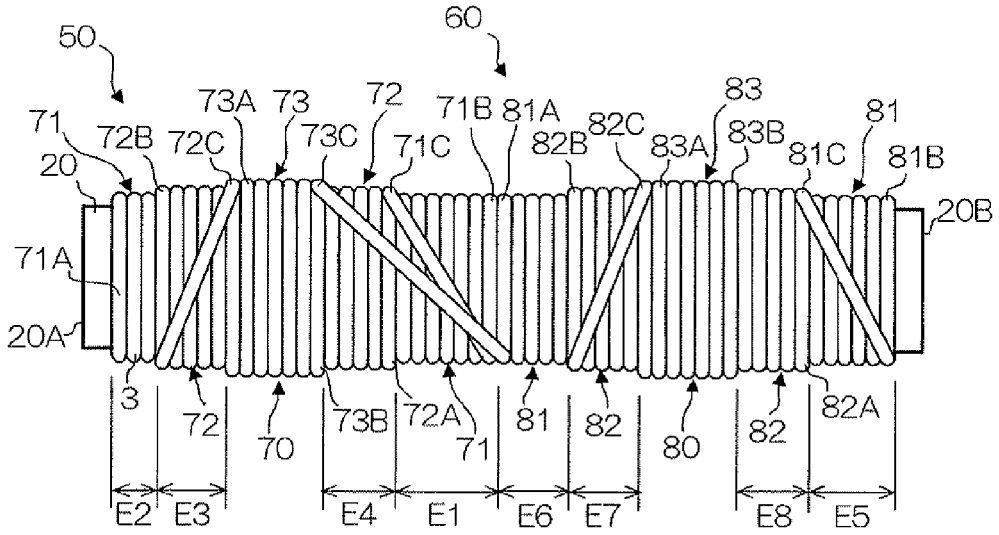
FIG. 3 is a schematic front view illustrating a divided winding coil component according to a second embodiment of the present invention.
Figure 4:
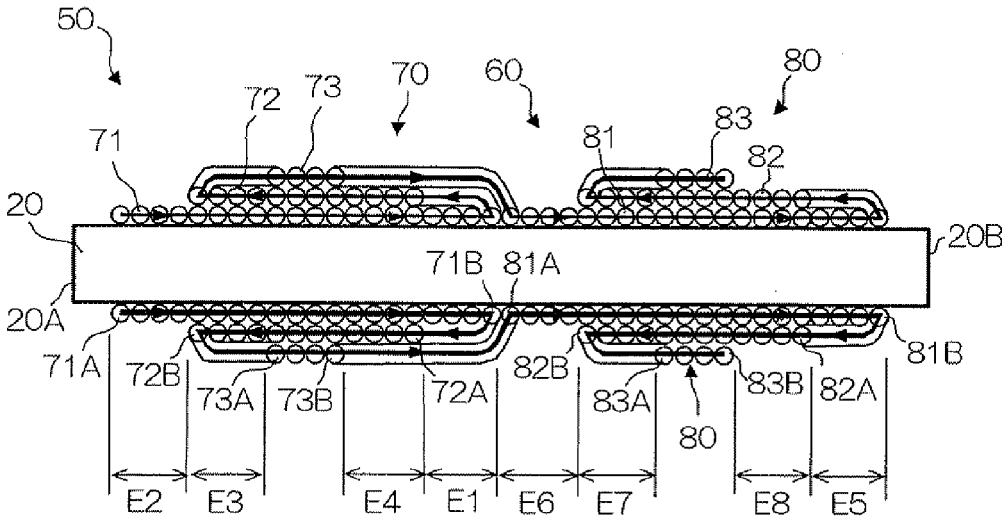
FIG. 4 is a schematic cross-sectional view illustrating a winding structure of a winding part in FIG. 3.

As illustrated in FIGS. 3 and 4, a coil component 50 according to a second embodiment of the present invention includes: the core 20 that does not include a flange part and is made of a bar-like magnetic body; and a winding part 60 including two divided winding parts 70 and 80 each formed of the conducting wire 3 that is wound in a plurality of layers around the longitudinal outer periphery of the core 20 according to a solenoidal winding method.

In FIGS. 3 and 4, the winding part 60 is formed by winding the left divided winding part 70 around the left half of the core 20 according to the solenoidal winding method and then winding the right divided winding part 80 around the right half of the core 20 according to the solenoidal winding method. The divided winding parts 70 and 80 are respectively formed of three winding layers of first winding layers 71 and 81, second winding layers 72 and 82, and third winding layers 73 and 83 in the stated order from the lower layer.

The winding structure is described. First, dense winding of the conducting wire 3 from a left end part 71A of the first winding layer 71 of the left divided winding part 70 is started with a slight space being kept from the left end 20A of the core 20. When the winding of the first winding layer 71 reaches a predetermined position near the center of the core 20 at a right end part 71B of the wound first winding layer 71, the conducting wire 3 is turned back in this portion, and winding from a right end part 72A of the second winding layer 72 is started with a winding collapse preventing shift E1 being set, the winding collapse preventing shift E1 corresponding to a plurality of turns (in FIG. 3, corresponding to seven turns) from the right end part 71B of the first winding layer 71.

On this occasion, at the time of the transition from the right end part 71B of the first winding layer 71 to the right end part 72A of the second winding layer 72, the conducting wire 3 is turned back from the right end part 71B of the first winding layer 71, and is obliquely wound in a small number of turns (in FIG. 3, in a ½ turn) across the winding collapse preventing shift E1, whereby oblique winding 71C is performed to provide a loosening preventing function. Then, dense winding of the second winding layer 72 is started. Specifically, the oblique winding 71C for loosening prevention is performed so as to fasten, from the outside, a portion of the winding wire 3 in two turns or more at the end part corresponding to the winding collapse preventing shift E1, whereby the occurrence of a disordered winding wire is prevented by the loosening prevention, in addition to the winding collapse prevention.

Next, the conducting wire 3 is densely wound in a predetermined number of turns on top of the first winding layer 71 from the right end part 72A to a left end part 72B of the second winding layer 72, and the conducting wire 3 reaches a position to which a predetermined winding collapse preventing shift E2 from the left end part 71 A of the first winding layer 71 located below the second winding layer 72 is set. After the winding to the left end part 72B, the conducting wire 3 is turned back in the opposite direction, and dense winding from a left end part 73A of the third winding layer 73 is started on top of the second winding layer 72. At the time of this turning back, a winding collapse preventing shift E3 is set to the left end part 72B of the second winding layer 72 similarly to the above, and the conducting wire 3 is wound by oblique winding 72C in a small number of turns (in FIG. 3, in a ½ turn) across the winding collapse preventing shift E3. Then, the dense winding from the left end part 73A of the third winding layer 73 is started. Also in this case, the oblique winding 72C provides a loosening preventing function, and the oblique winding 72C for loosening prevention is performed so as to fasten, from the outside, a portion of the winding wire 3 in two turns or more at the end part corresponding to the winding collapse preventing shift E3, whereby the occurrence of a disordered winding wire is prevented by the loosening prevention, in addition to the winding collapse prevention.

Subsequently, the conducting wire 3 is wound in a predetermined number of turns from the left end part 73A to a right end part 73B of the third winding layer 73. Specifically, the conducting wire 3 is wound to a position of the right end part 738 of the third winding layer 73 as the uppermost layer, that is, to a position to which a predetermined winding collapse preventing shift E4 from the right end part 72A of the second winding layer 72 located below the third winding layer 73 is set.

The conducting wire 3 after the winding end at the right end part 73B of the third winding layer 73 is wound by oblique winding 73C (actually on the back side) in a small number of turns (in FIG. 3, a ½ turn) across an amount of shift including the winding collapse preventing shift E4 for the right end part 72A of the second winding layer 72 and the winding collapse preventing shift E1 for the right end part 71B of the first winding layer 71. Winding from a left end part 81A of the first winding layer 81 of the right divided winding part 80 is started so as to be continuous with the right end part 71B of the first winding layer 71 of the left divided winding part 70 around the outer periphery of the core 20. Note that the oblique winding 73C is located on the back side in FIG. 3, and thus should be illustrated by a broken line, but is illustrated by a solid line for ease of understanding.

When the winding of the first winding layer 81 of the right divided winding part 80 reaches a predetermined position at a right end part 81B of the wound first winding layer 81 with a slight space being kept from the right end 20B of the core 20, the conducting wire 3 is turned back in this portion, and winding from a right end part 82A of the second winding layer 82 is started with a winding collapse preventing shift E5 being set, the winding collapse preventing shift ES corresponding to a plurality of turns (in FIG. 3, corresponding to six turns) from the right end part 81B of the first winding layer 81.

On this occasion, at the time of the transition from the right end part 81B of the first winding layer 81 to the right end part 82A of the second winding layer 82, the conducting wire 3 is turned back from the right end part 81B of the first winding layer 81, and is obliquely wound in a small number of turns (in FIG. 3, in a ½ turn) across the winding collapse preventing shift ES, whereby oblique winding 81C is performed to provide a loosening preventing function. Then, dense winding of the second winding layer 82 is started. Specifically, the oblique winding 81C for loosening prevention is performed so as to fasten, from the outside, a portion of the winding wire 3 in two turns or more at the end part corresponding to the winding collapse preventing shift E5, whereby the occurrence of a disordered winding wire is prevented by the loosening prevention, in addition to the winding collapse prevention.

Next, the conducting wire 3 is densely wound in a predetermined number of turns on top of the first winding layer 81 from the right end part 82A to a left end part 82B of the second winding layer 82, and the conducting wire 3 reaches a position to which a predetermined winding collapse preventing shift E6 from the left end part 81A of the first winding layer 81 located below the second winding layer 82 is set. After the winding to the left end part 82B, the conducting wire 3 is turned back in the opposite direction, and dense winding from a left end part 83A of the third winding layer 83 is started on top of the second winding layer 82. At the time of this turning back, a winding collapse preventing shift E7 is set to the left end part 82B of the second winding layer 82 similarly to the above, and the conducting wire 3 is wound by oblique winding 82C in a small number of turns (in FIG. 3, in a ½ turn) across the winding collapse preventing shift E7. Then, the dense winding from the left end part 83A of the third winding layer 83 is started. Also in this case, the oblique winding 82C provides a loosening preventing function, and the oblique winding 82C for loosening prevention is performed so as to fasten, from the outside, a portion of the winding wire 3 in two turns or more at the end part corresponding to the winding collapse preventing shift E7, whereby the occurrence of a disordered winding wire is prevented by the loosening prevention, in addition to the winding collapse prevention.

Subsequently, the conducting wire 3 is wound in a predetermined number of turns from the left end part 83A to a right end part 83B of the third winding layer 83. Specifically, the conducting wire 3 is wound to a position of the right end part 83B of the third winding layer 83 as the uppermost layer, that is, to a position to which a predetermined winding collapse preventing shift E8 from the right end part 82A of the second winding layer 82 located below the third winding layer 83 is set.

A leading end of the conducting wire 3 on the winding end side at the right end part 83B of the third winding layer 83 is taken out together with a leading end of the conducting wire 3 on the winding start side in the left divided winding part 70, and both the leading ends thereof are connected to a circuit part (not illustrated).

<Other Modified Embodiments>

Hereinabove, the embodiments of the present invention are described, but the present invention is not limited to the above-mentioned embodiments, and thus can be variously modified.

For example, it is assumed in the above-mentioned embodiments that the core 20 has a round bar-like shape circular in cross-section, but the core 20 may have a flattened bar-like shape rectangular, elliptical, or oval in cross-section and various other shapes that enable downsizing.

The coil component according to the present invention includes: the bar-like core not including the flange part; and the winding part formed of the conducting wire that is wound in the plurality of layers around the outer periphery of the core according to the solenoidal winding method while being turned back sequentially from the lower layer to the upper layer with the winding collapse preventing shift being set. Accordingly, the coil component can produce the following operations and effects.

That is, the use of the bar-like core not including the flange part can reduce the diameter or width of the core, and this reduction in size can lead to compactification. As a result, for example, requirements for a minute antenna coil component (a coil component for a tag) can be satisfied, Further, the winding collapse preventing shift corresponding to the plurality of turns between the end part of the lower winding layer and the end part of the upper winding layer is set to each end part in the winding width direction of each winding layer of the winding part according to the solenoidal winding method. Accordingly, even if the core is not provided with the flange part, the winding part formed of the conducting wire that is tidily wound in order can be configured without the occurrence of winding collapse and thickening due to the winding, whereby stable coil characteristics can be secured.

Moreover, in the case of the transition from the lower winding layer to the upper winding layer in the winding part, the conducting wire is turned back from the end part of the lower winding layer, and is obliquely wound in the small number of turns across the winding collapse preventing shift corresponding to the plurality of turns, and the dense winding of the upper winding layer is started. Winding for loosening prevention is thus performed so as to fasten, from the outside, a portion of the winding wire at the end part corresponding to the winding collapse preventing shift of each winding layer. Accordingly, the occurrence of a disordered winding wire can be prevented by the loosening prevention, in addition to the winding collapse prevention, and stable characteristics can be maintained for a long period. In addition, the outer diameter of each end part of the winding part is smaller, resulting in an effect of facilitating wiring of a winding start portion or a winding end portion of the winding wire.

Further, even in the case where the conducting wire is divided wound in the winding part, the conducting wire is wound in each divided winding part in the state where the winding collapse preventing shift corresponding to the plurality of turns between the end part of the lower winding layer and the end part of the upper winding layer is set to each end part of each winding layer of each divided winding part. Accordingly, the occurrence of winding collapse can be prevented, and the occurrence of a disordered winding wire can be prevented by the loosening preventing winding, so that characteristics of the divided winding according to the solenoidal winding method can be stably maintained for a long period.

At that time, particularly in the case where the conducting wire is wound in the winding part so as to be divided into the divided winding parts even in the lowermost winding layer, excellent divided winding characteristics can be secured.

Note that the number of winding layers put on top of each other in the winding part, the number of divisions in the divided winding, the number of turns for the winding collapse preventing shift, and the like are set as appropriate on the basis of specifications suited to the intended use, required performance, and the like of the coil component.

What is claimed is:

1. A coil component comprising:

a bar-like core not including a flange part; and a winding part formed of a conducting wire that is wound in a plurality of layers around a longitudinal outer periphery of the core according to a solenoidal winding method while being turned back sequentially from a lower layer to an upper layer, the coil component further being provided with a winding collapse preventing shift part comprising a space corresponding to a plurality of turns between an end part of a lower winding layer and an end part of an upper winding layer, the winding collapse preventing shift part being set to each end part in a winding width direction of each winding layer of the winding part, wherein the winding collapse preventing shift part is provided with an intermediate winding part in which one end is connected to one end of the lower winding layer and an other end is connected to one end of the upper winding layer, the intermediate winding part is wound obliquely with respect to a longitudinal direction of the core of an upper layer of the collapse preventing shift part corresponding to the plurality of turns with less turns than other winding parts, and the upper winding layer and the lower winding layer are wound with more and closer turns than the intermediate winding part.

2. The coil component according to claim 1, wherein continuous conducting wire is dividedly wound in the winding part, and the intermediate winding part is provided in each divided winding part in a state where the winding collapse preventing shift part corresponding to the plurality of turns between the end part of the lower winding layer and the end part of the upper winding layer is set to each end part in the winding width direction of each winding layer of each divided winding part.

3. The coil component according to claim 2, wherein the conducting wire is wound in the winding part so as to be divided into the divided winding parts even in a lowermost winding layer.

4. The coil component according to claim 2, wherein the intermediate winding part in a case of transition from a given divided winding part to a next divided winding part during the divided winding is providing by obliquely winding the conducting wire across a total shift of the winding collapse preventing shift parts of a plurality of layers at an end part of the given divided winding part, and at one end of a lowermost winding layer of the next divided winding part.

5. The coil component according to claim 1, wherein the plurality of turns to which the winding collapse preventing shift part corresponds is four to ten turns.

6. The coil component according to claim 1, wherein the turning back of the conducting wire of the intermediate winding part from the end part of the lower winding layer and the oblique winding thereof across the winding collapse preventing shift part prevents a disordered winding wire by loosening prevention, in addition to winding collapse prevention.

* * * * *